US007556593B2

(12) United States Patent
Sato

(10) Patent No.: US 7,556,593 B2
(45) Date of Patent: Jul. 7, 2009

(54) INFERIOR LIMB MUSCLE FORCE TRAINING APPARATUS

(76) Inventor: Hidefumi Sato, 612, Aza-Umasinden, Oh-Aza-Maegasusinden, Yatomi-Cho, Ama-Gun, Aichi (JP) 498-0017

( * ) Notice: Subject to any disclaimer, the term of this patent is extended or adjusted under 35 U.S.C. 154(b) by 676 days.

(21) Appl. No.: 11/255,341

(22) Filed: Oct. 21, 2005

(65) Prior Publication Data

US 2006/0160676 A1 Jul. 20, 2006

(30) Foreign Application Priority Data

Jan. 18, 2005 (JP) ..... 2005-010904

(51) Int. Cl.
*A63B 21/06* (2006.01)
*A63B 23/04* (2006.01)

(52) U.S. Cl. ..... 482/95; 482/101; 482/135; 482/142; 601/26; 601/35

(58) Field of Classification Search ..... 482/92–99, 482/101, 133, 135, 142, 143; 601/23, 24, 601/26, 34, 35
See application file for complete search history.

(56) References Cited

U.S. PATENT DOCUMENTS 1,470,403 A * 10/1923 Thalken ..... 482/128
3,807,728 A * 4/1974 Chillier ..... 482/101
4,357,010 A * 11/1982 Telle ..... 482/97
4,872,670 A * 10/1989 Nichols ..... 482/135
5,056,777 A * 10/1991 Capjon et al. ..... 482/101
5,108,095 A * 4/1992 Nichols ..... 482/137
5,201,694 A * 4/1993 Zappel ..... 482/133
5,419,752 A * 5/1995 James et al. ..... 601/5
5,549,529 A * 8/1996 Rasmussen ..... 482/96
5,711,749 A * 1/1998 Miller ..... 482/135
6,015,369 A * 1/2000 Rasmussen ..... 482/96
6,231,486 B1 * 5/2001 Lee ..... 482/101
6,482,134 B1 * 11/2002 Rasmussen ..... 482/96
6,632,160 B2 * 10/2003 LaFond et al. ..... 482/95
2006/0247097 A1 * 11/2006 La Voie et al. ..... 482/8

FOREIGN PATENT DOCUMENTS

DE 3529895 A1 * 2/1987
JP 2730882 11/1997
JP 2892985 11/1997
JP 2002-336374 11/2002
JP 2003-175085 6/2003
JP 2004-209076 7/2004

* cited by examiner

*Primary Examiner*—Loan H Thanh
*Assistant Examiner*—Victor K Hwang
(74) *Attorney, Agent, or Firm*—Ohlandt, Greeley, Ruggiero & Perle, L.L.P

(57) ABSTRACT

An inferior limb muscle force training apparatus is provided with a supporting strut standing vertically, a seat body provided so as to be capable of ascending/descending along the supporting strut, and a weight balancing mechanism which applies a lift force to the seat body, wherein the seat body is provided with a saddle type seat portion and a pair of shoulder pads, and the weight balancing mechanism is constituted to be capable of adjusting a lift force applied to the seat body properly by winding ropes on pulleys provided on an upper portion of the supporting strut, linking one ends of the ropes to the seat body, and linking the other ends thereof to a weight placing stand provided on a back side of the supporting strut so as to be capable of ascending and descending.

5 Claims, 8 Drawing Sheets

INFERIOR LIMB MUSCLE FORCE TRAINING APPARATUS

FIELD OF THE INVENTION

The present invention relates to an inferior limb muscle force training apparatus for physically building up the muscle force of a person to recover or improve his/her standing and walking ability.

DISCUSSION OF THE BACKGROUND ART

Training apparatuses for building up the muscle force of a leg or an arm of a person by reciprocating an arm of the training apparatus by his/her foot or arm in his/her seating attitude to ascend and descend a balancing weight connected to the arm thereof via a rope are disclosed in Japanese Patent No. 2730882 and Japanese Patent No. 2892985, and the like. Further, a training apparatus where a person lies up on a bed, whereby his/her feet hook the arms of the apparatus, and he/she flexes and extends are described in Japanese Patent Application Disclosure No. 2003-175085 and Japanese Patent Application Disclosure No. 2004-209076, and the like. An apparatus for training an inferior limb function of a patient, who has difficulty walking by lifting him/her up on a roller utilizing wires and causing him/her to walk thereon is disclosed in Japanese Patent Application Disclosure No. 2002-336374.

Now, for example, there are many persons who lose their physical muscle forces due to a continuation of a bedridden state for medical treatment, to become unable to walk and are confined to a wheelchair. However, since the above conventional training apparatus is constituted such that a person does his/her exercise in such a state that he/she is sitting on a seat, he/she lies on his/her bed, or he/she is lifted up by wires, there is such a problem that his/her muscles required when he/she stands up or sits down cannot be trained properly. Therefore, there is such a problem that it is difficult to recover muscle forces of his/her left and right legs which are required for standing up or walking with an excellent balance, a long period is required for rehabilitation, and much burden is imparted to a helper because it is difficult to achieve a sufficient training effect.

In view of these circumstances, the present invention has been made and an object thereof is to provide an inferior limb muscle force training apparatus which can train inferior limb muscle forces of an user effectively in conformity with his/her aspect and can recover or increase his/her standing-up, walking or athletic ability securely.

SUMMARY OF THE INVENTION

An inferior limb muscle force training apparatus comprising: a supporting strut standing vertically, a seat body provided so as to be capable of ascending/descending along the supporting strut, and a weight balancing mechanism for applying a lift force to the seat body, the seat body is provided with a saddle type seat portion, and the weight balancing mechanism is constituted to be capable of adjusting the lift force applied to the seat body properly.

The inferior limb muscle force training apparatus, where the seat body is provided with a pair of shoulder pads.

The inferior limb muscle force training apparatus, wherein the weight balancing mechanism is constructed such that a rope is wound on a pulley provided on an upper portion of the supporting strut, one end of the rope is linked to the seat body, and the other end of the rope is linked to a weight placing stand provided on a back side of the supporting strut to be capable of ascending/descending.

The inferior limb muscle force training apparatus, wherein the weight balancing mechanism is constructed such that a weight holding frame is fixed to a rear side of the supporting strut, a plurality of rod-shaped balancing weights are inserted into the weight holding frame vertically and a weight locking means which can be set so as to enable or disable ascending/descending movement of each balancing weight is provided on the weight holding frame, and only a load of the balancing weight set to enable ascending/descending movement by the weight locking means is applied to the weight placing stand.

According to the present invention the muscles of an inferior limb, a hip, arms, and a chest of a person and the like required when he/she stands up or sits down can be trained comprehensively. Therefore, the standing-up or walking ability can be recovered promptly.

A user flexes and extends his legs in a state that his/her both shoulders have been loaded so that a load on his/her inferior limb muscle can be increased. The seat body can be balanced easily regarding its weight.

Since setting can be made possible so as to correspond to a weight or a muscle force of a user or his/her intended use, a secure training can be conducted reasonably regardless of a person unable to walk or an able-bodied person.

DETAILED DESCRIPTION OF THE PREFERRED EMBODIMENT

Figure 1:
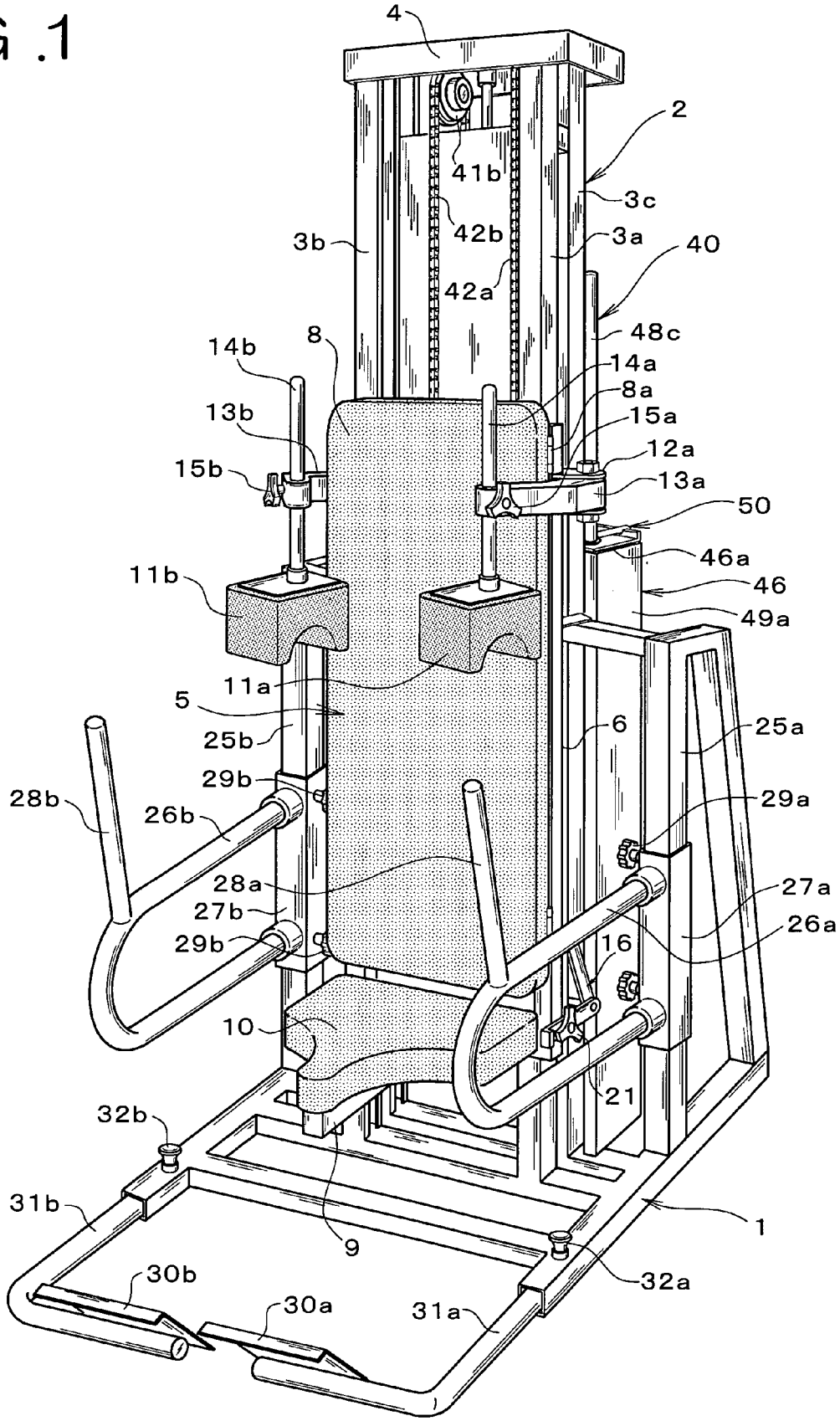
FIG. 1 is a perspective view of an inferior limb muscle force training apparatus according to the present invention.
Figure 2:
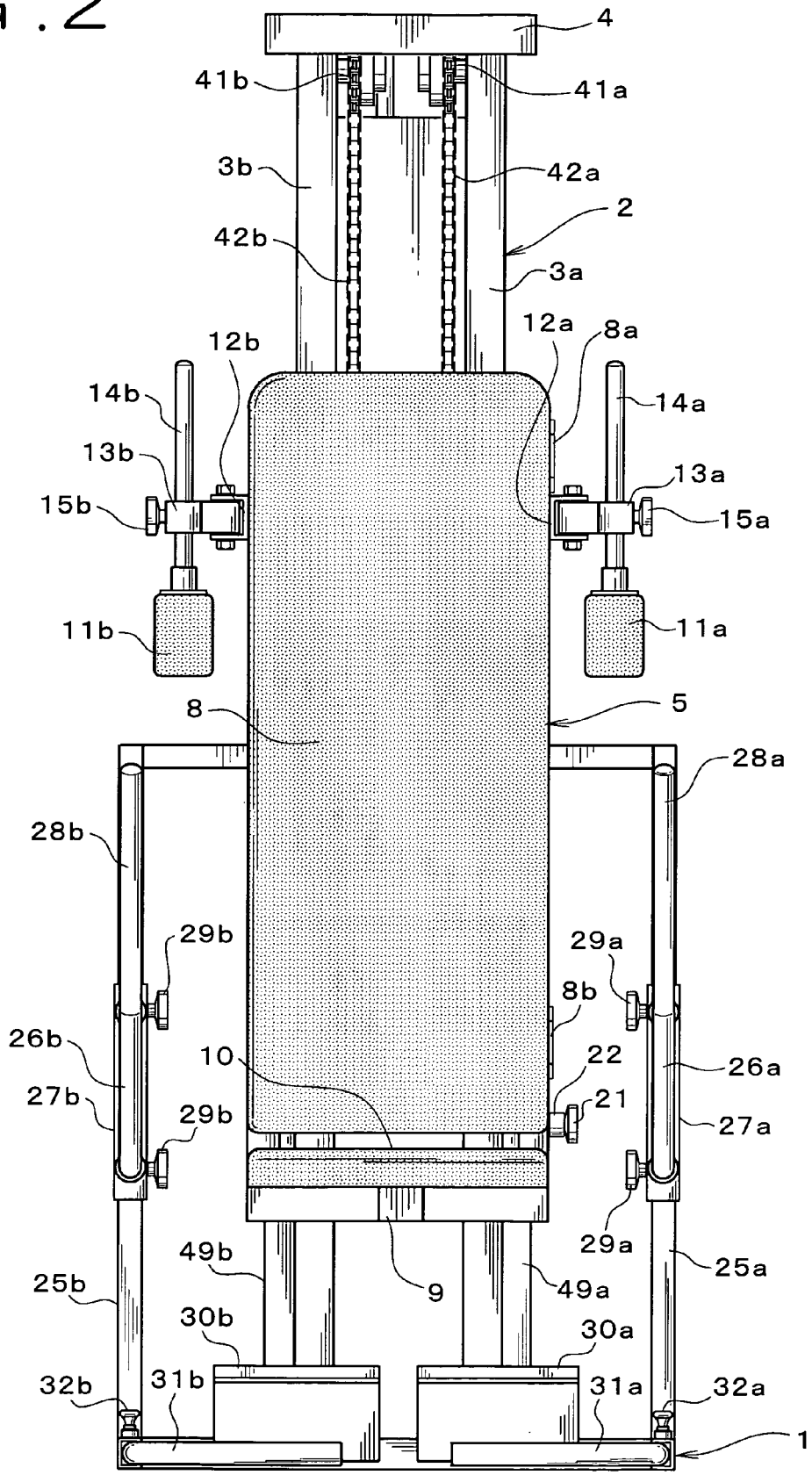
FIG. 2 is a front view of the inferior limb muscle force training apparatus according to the present invention.
Figure 3:
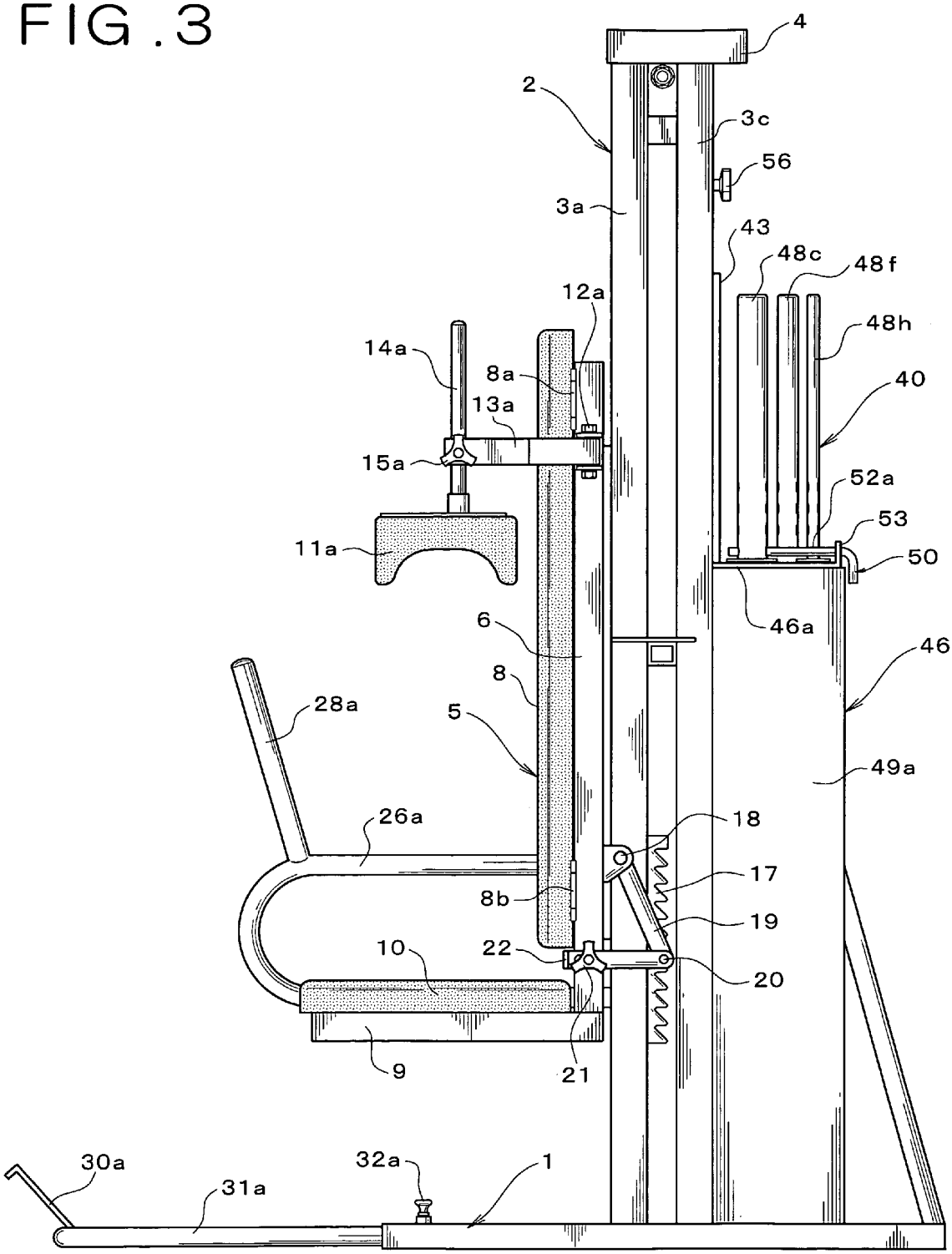
FIG. 3 is a partially sectional side view of the inferior limb muscle force training apparatus according to the present invention.
Figure 4:
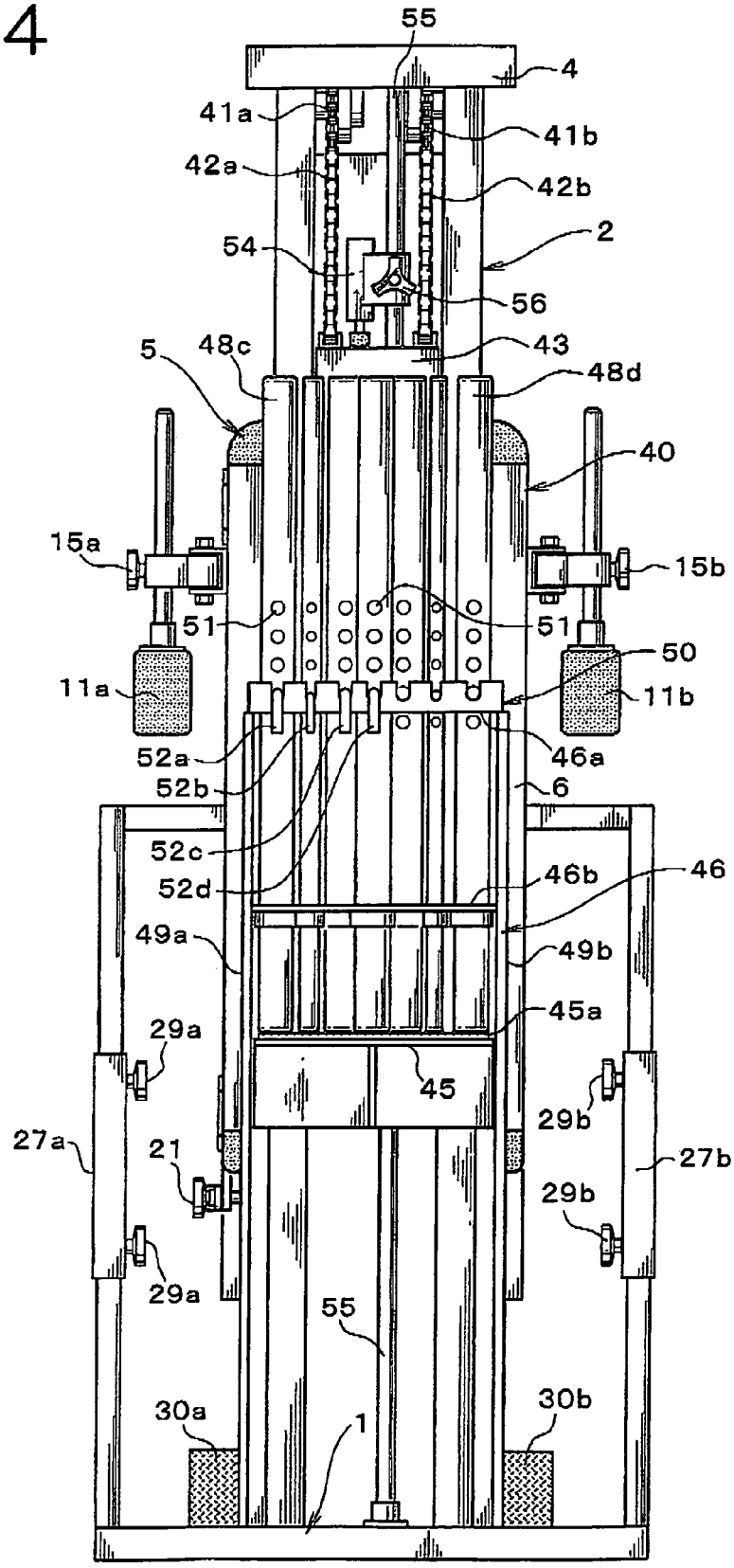
FIG. 4 is a back view of the inferior limb muscle force training apparatus according to the present invention.
Figure 5:
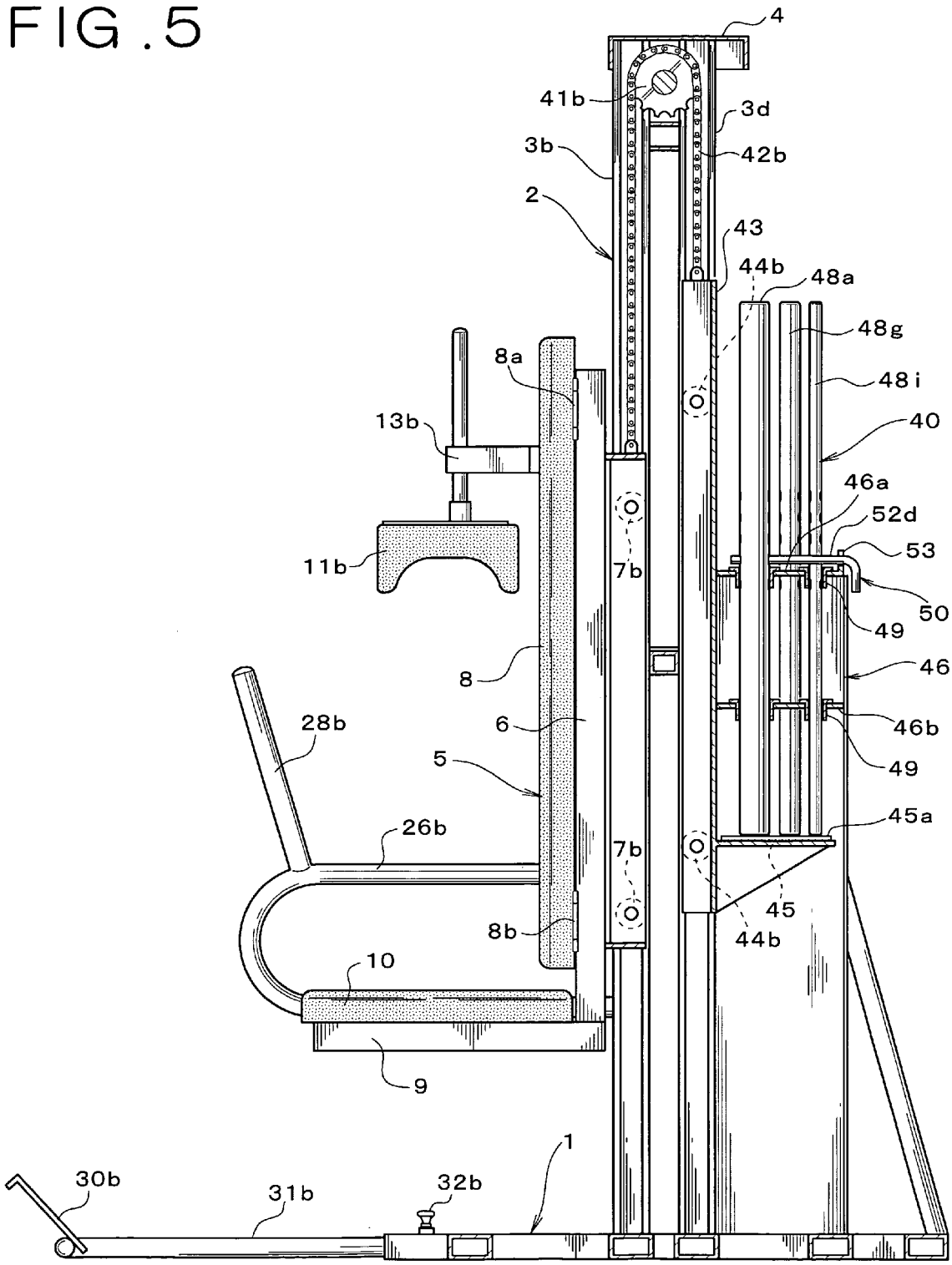
FIG. 5 is a longitudinal sectional view of the inferior limb muscle force training apparatus according to the present invention.
Figure 6:
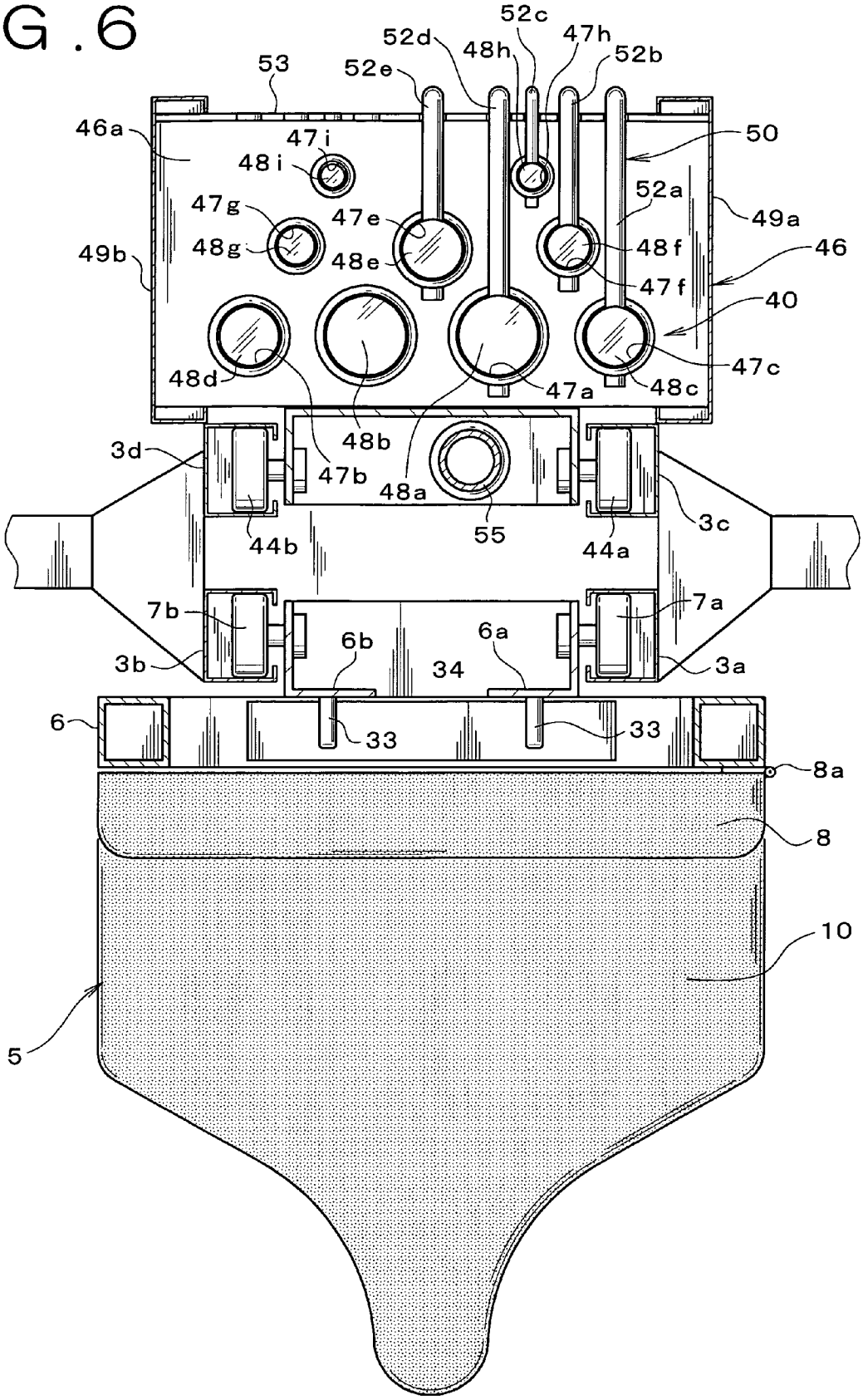
FIG. 6 is a horizontal sectional view of the inferior limb muscle force training apparatus according to the present invention.

Next, preferred embodiments of the present invention will be explained with reference to the drawings. In FIG. 1 to FIG. 6, reference numeral 1 denotes a base frame arranged on a floor face stably, and reference numeral 2 denotes a supporting strut standing vertically on a central portion of the base frame. The base frame 1 is formed in a rectangular frame shape using pipes with a rectangular section. The supporting strut 2 is formed in a gate shape by arranging shape steels with a U-shaped cross section 3*a* to 3*d* on the base frame in an opposing manner and fixing a horizontal member 4 to upper portions of the shape steels. Reference numeral 5 denotes a seat body arranged on a front face of the supporting strut 2 so as to be capable of ascending/descending along the supporting strut. As shown in FIG. 5 and FIG. 6, in the seat body 5, rollers 7*a* and 7*b* projecting sideward are provided on back face structural members 6*a* and 6*b* of a seat frame 6, so that the respective rollers are slidable on inner faces of the shape steels 3*a* and 3*b*. Thereby, the seat frame is provided so as to be capable of ascending and descending along the supporting strut 2. A back plate 8 is provided on a front face of the seat frame via hinges 8*a* and 8*b*, a receiving portion 9 projecting forward is provided on a lower portion of the seat frame, and a saddle type seat portion 10 is horizontally provided on the receiving portion. Incidentally, surfaces of the back plate 8 and the saddle type seat portion 10 are covered with skins with cushioning property.

Reference numerals 11*a* and 11*b* denote a pair of shoulder pads provided on the seat body 5. The shoulder pads are each constituted by forming a lower face of elastic material such as foamed urethane rubber in a recessed shape in conformity with the rounding of a shoulder of a person and covering the elastic material with a skin. Stays 13*a* and 13*b* are supported by bearings 12*a* and 12*b* provided on both upper sides of the seat frame 6 to be capable of pivoting in a horizontal plane, shafts 14*a* and 14*b* are inserted into front ends of the stays and the shafts 14*a* 14*b* are fixed by thumb screws 15*a* and 15*b* in a vertically extending manner, and the shoulder pads 11*a* and 11*b* are fixed to a lower face of a mounting plate provided on lower ends of the respective shafts. Therefore, a distance between both the shoulder pads 11*a* and 11*b* can be adjusted in conformity with a shoulder length of a user by pivoting the stays 13*a* and 13*b*, and a distance between the shoulder pads and an upper face of the saddle type seat portion 10 can be adjusted in conformity with his/her seated height by loosing the thumb screws 15*a* and 15*b*.

Reference numeral 16 denotes a height adjusting mechanism which can set an initial set height of the seat body 5 properly in conformity with a lengths of the feet of a person. As shown in FIG. 3, the height adjusting mechanism is constituted such that rack teeth 17 are fixed on a back face of the shape steel 3*a*, a bearing 18 is provided on one side of a back face of the seat frame 6 to pivot one end of a link 19, an engaging shaft 20 is horizontally provided on a front end portion of the link, the engaging shaft 20 meshes with the rack teeth 17 due to a self-weight thereof, an operation lever 22 is provided to be operable for forward and backward movements by a thumb screw 21 screwed to one side of the seat frame 6, and a front end of the operation lever 22 is pivoted to the engaging shaft 20. Therefore, by loosing the thumb screw 21 to move the operation lever 22 forward or backward, the engaging shaft 20 is caused to mesh with the rack teeth 17 properly so that the seat body 5 can be fixed at a desired height.

Reference numerals 25*a* and 25*b* denote side frames formed of pipes with a rectangular cross section provided at both sides of the supporting strut 2, and reference numerals 26*a* and 26*b* denote a pair of handrails attached to the side frame to be adjustable in height. The handrails are each formed by bending a pipe with a circular cross section in an U-shape, cylindrical bodies 27*a* and 27*b* are provided on outer peripheries of the side frames so as to be vertically slidable, and the handrails are provided so as to expand forwardly and horizontally from the side frames by fixing base portions of the handrails to the cylindrical bodies. Gripping rods 28*a* and 28*b*, each formed of a linear pipe with a circular cross section, are provided at front end portions of the hand rails obliquely and forwardly in a standing manner. Reference numerals 29*a* and 29*b* denote thumb screws screwed to the cylindrical bodies 27*a* and 27*b*. The handrails 26*a* and 26*b* are made adjustable by loosing the thumb screws so that they can be set at a desired heights.

Reference numerals 30*a* and 30*b* denote foot boards on which a user can put his/her feet. The foot boards are provided at front end portions of a pair of extension frames 31*a* and 31*b*, each formed of a pipe with a circular cross section folded to an L-shape within a horizontal plane such that they are obliquely opposed to the seat body 5 in a plate-like manner, base portions of the respective extension frames are loosely fitted into front opening ends of the base frame 1 to be stretchable and retractable, and a distance from the seat body 5 can be adjusted properly in conformity with lengths of feet of a user by loosing the thumb screws 32*a* and 32*b* screwed near the opening ends.

Figure 7:
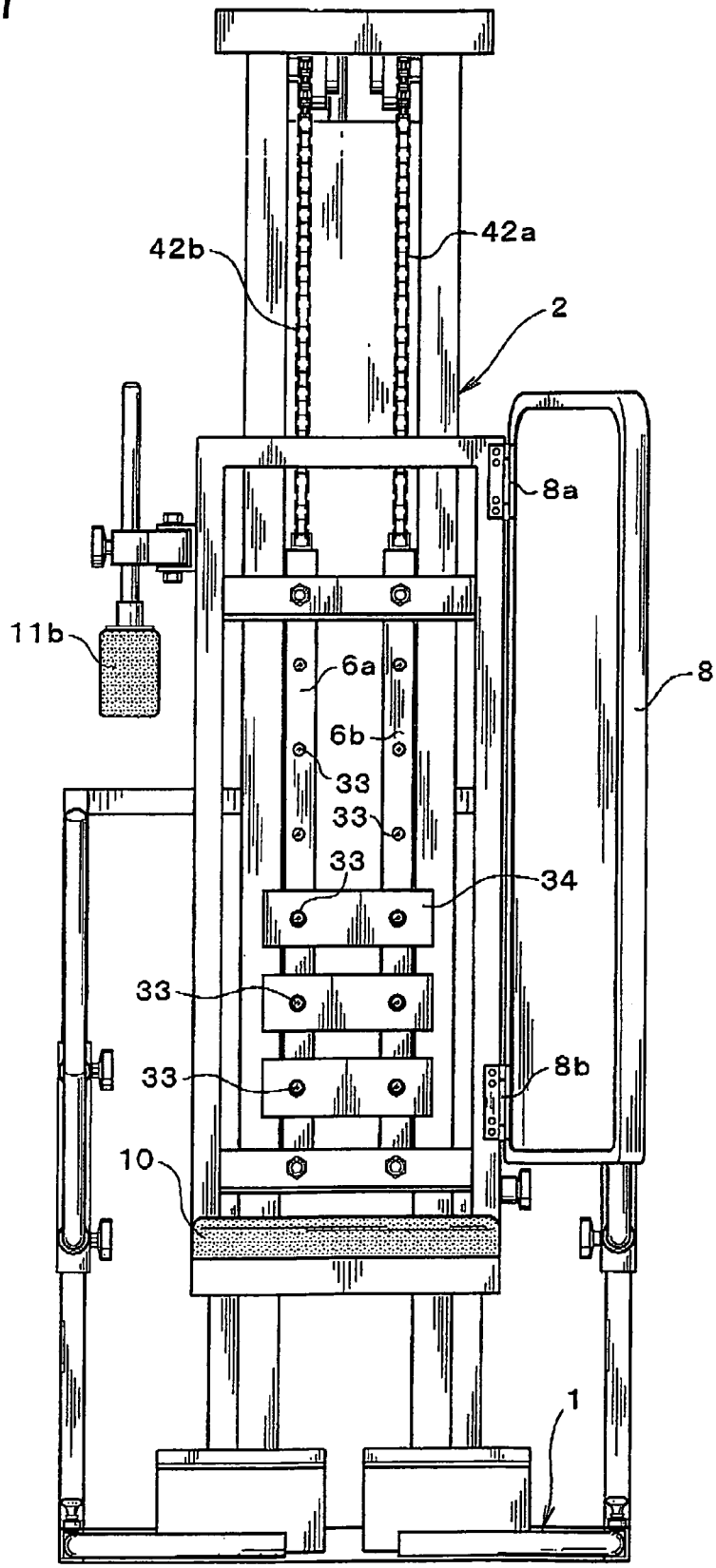
FIG. 7 is a front view of the inferior limb muscle force training apparatus according to the present invention where a back plate of a seat body has been opened.

As shown in FIG. 7, a plurality of pins 33 are provided on front faces of the back face structural members 6*a* and 6*b* in the seat frame 6, and block-like weights 34 can be attachably/detachably set to the pins. Incidentally, the weight(s) 34 is covered with the back plate 8 in an ordinary situation, and the back plate 8 is provided on the front face of the seat frame 6 so as to be capable of being opened and closed via hinges 8*a* and 8*b*. Therefore, by opening the back plate, as shown in FIG. 7, a plurality of weights 34 are attached to the pins according to need, so that a total weight of the seat body 5 can be increased or decreased.

Pulleys 41*a* and 41*b* constituted of a pair of sprockets are provided on an upper portion of the supporting strut 2, ropes 42*a* and 42*b* constituted of chains are wound on the pulleys, and one ends of the ropes 42*a* and 42*b* are linked at upper end portions of the back face structural members 6*a* and 6*b* of the seat frame 6. Next, the weight balancing mechanism 40 provided on a rear side of the supporting strut 2 for applying a lift force to the seat body 5 will be explained. A weight placing stand frame 43 is disposed between the shape steels 3*a* and 3*b* on the back side of the support strut 2, rollers 44*a* and 44*b* are provided on both side edges of the weight placing stand frame 43, the weight placing stand frame 43 is provided so as to be capable of ascending and descending along the supporting strut 2 by sliding the rollers on inner faces of the shape steels 3*c* and 3*d*, and the other ends of the ropes 42*a* and 42*b* are linked to an upper end portion of the weight placing stand frame. A weight placing stand 45 projecting backward and horizontally is provided integrally on a lower portion of the weight placing stand frame 43. Reference numeral 46 denotes a weight holding frame which is constituted such that flat plates 46*a* and 46*b* are horizontally fixed on back faces of the shape steels 3*c* and 3*d* and whose both side edges are supported by side plates 49*a* and 49*b*. A plurality of circular through-holes 47*a* to 47*i* whose diameters are different from one another are formed in the flat plates 46*a* and 46*b* in a vertically penetrating manner, as shown in FIG. 6, and a plurality of rod-shaped balancing weights 48*a* to 48*i* which are different in thickness from one another are vertically inserted into the respective through-holes. Incidentally, reference numeral 49 denotes resin-made bushes provided on inner peripheries of the through-holes 47*a* to 47*i* such that the respective balancing weights can ascent and descent freely with small friction. Therefore, lower ends of the respective balancing weights 48*a* to 48*j* ride on the weight placing stand 45 and weights of the respective balancing weights 48*a* to 48*i* are loaded on the weight placing stand frame 43. Reference numeral 45*a* denotes a plate-like buffer member made of rubber provided on the weight placing stand 45 in an expanding manner in order to reduce impacts from lower end portions of respective balancing weights.

Weight locking means 50 which can set to enable or disable ascending/descending movement of the respective balancing weights are provided on the balancing weights. As shown in FIG. 4, the weight locking means are constituted such that lateral holes 51, 51, 51, . . . are formed in the respective balancing weights 48*a* to 48*i* in a through-hole manner and large and small rod-shaped wrenches 52*a*, 52*b*, 52*c*, . . . are provided so as be inserted into and pulled out of the lateral holes on the flat plate 46*a*. Since the balancing weight inserted with the wrench is supported on the flat plate 46*a* by the wrench, it is prevented from lowering so that a load thereof is not imparted on the weight placing stand 45, while only a load of the balancing weight which is not inserted with the wrench is imparted on the weight placing stand 45. Incidentally, weights of the balancing weights 48*a* and 48*b* are 10 kg, weights of the balancing weights 48*c* to 48*e* are 5 kg, a weight of the balancing weight 48*f* is 3 kg, a weight of the balancing weight 48*g* is 2 kg, a weight of the balancing weight 48*h* is 1 kg, and a weight of the balancing weight 48*i* is 0.5 kg. Therefore, by combining the plurality of balancing weights properly, a load applied to the weight placing stand 45 can be set to a range from 0.5 kg to 41.5 kg on 0.5 kg base. Further, reference numeral 53 denotes an locking plate which is formed on a rear end edge of the flat plate 46*a* in a standing manner and formed with U-shaped notches so as to lock the respective wrenches 52*a*, 52*b*, 52C. As shown in FIG. 4, the respective wrenches can be positioned by engagements thereof with the notches. Reference numeral 54 denotes a hydraulic damper for impact absorption fixed on an auxiliary strut 55 provided between the shape steels 3*c* and 3*d* in a standing manner so as to be opposed to an upper end face of the weight placing stand frame 43. Ascending of the weight placing stand frame 43 is stopped by collision of the weight placing stand frame 43 against the hydraulic damper. Reference numeral 56 denotes a thumb screw provided so as to allow change of a set height of the hydraulic damper.

In the inferior limb muscle force training apparatus thus constituted, loads imparted to both ends of the ropes 42*a* and 42*b* are balanced, or the seat body 5 side is set to be heavier than the balancing weight load or the seat body 5 side is set to be lighter than the balancing weight load according to a user's intended use by pulling the wrench(es) regarding a proper number of balancing weights to apply a load of the weights on the weight placing stand 45. Incidentally, it is desirable for safety that the engaging shaft 20 is put in engagement with the rack teeth 17 during such a set adjusting operation so that the seat body 5 is prevented from ascending/descending unnecessarily. The number of balancing weights attachable within the seat frame 6 is increased/decreased according to need so that balance adjustment can be made possible in a wide range according to a user's intended use. By providing the plurality of balancing weights 48*a* to 48*i* whose weights are different from one another, fine setting can be made possible according to a user's weight or muscle force(s).

Figure 8:
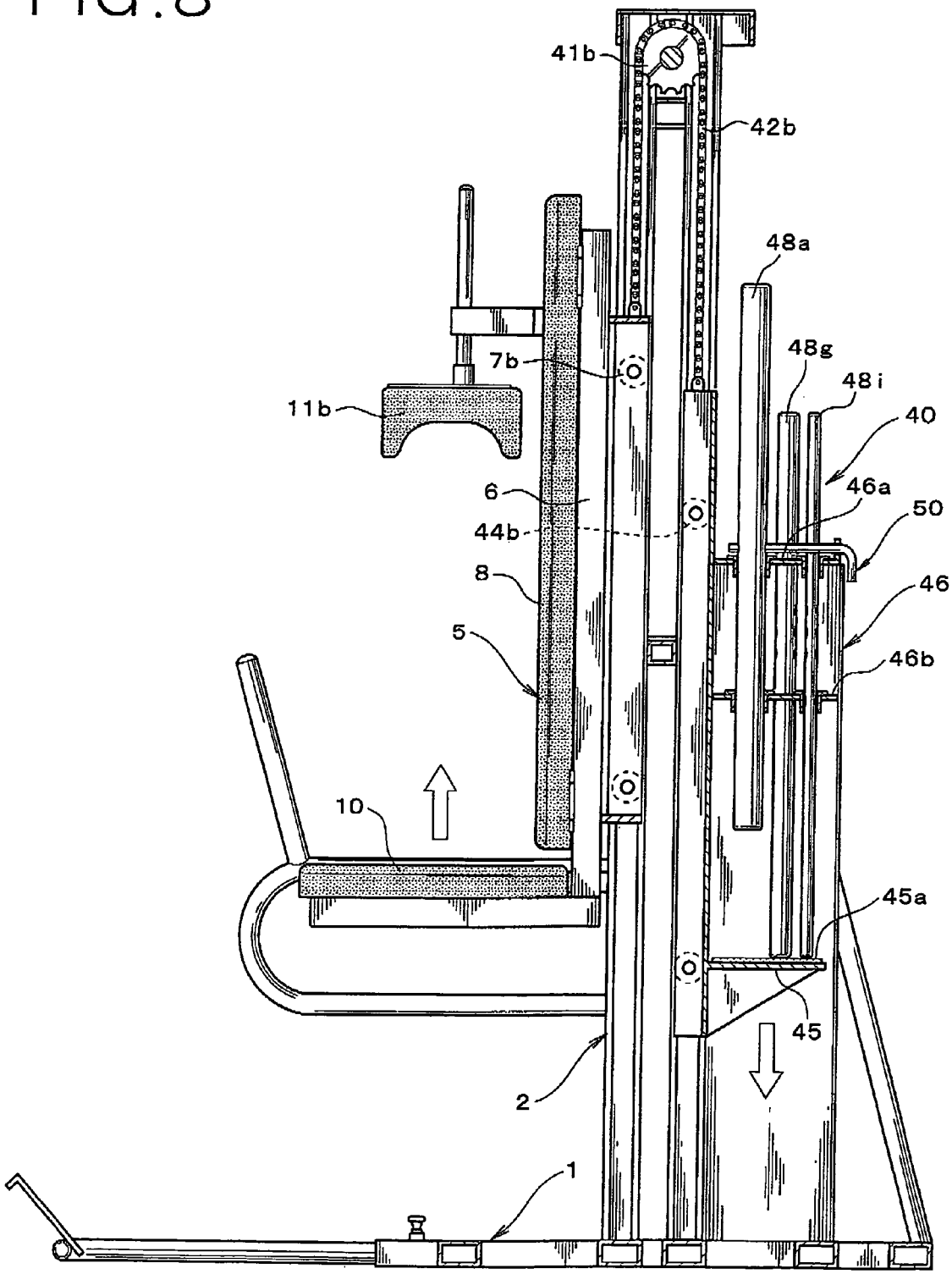
FIG. 8 is an operating state view of the inferior limb muscle force training apparatus according to the present invention shown in FIG. 5.

When training starts, after proper setting has been made according to a user's weight or muscle(s), or his/her intended use, he/she sits on the saddle type seating portion 10 so as to straddle the same, brings his/her back in close contact with the back plate 8, puts the shoulder pads 11*a* and 11*b* to his/her both shoulders, puts his/her both feet on the foot boards 30*a* and 30*b*, grasps the gripping rods 28*a* and 28*b* with his/her both hands, disengages the engaging shaft 20, and flexes and extends his/her both legs simultaneously so that he/she ascends and descends the seat body 5, as shown in FIG. 8. At that time, for example, if setting is made such that the weight placing stand 45 is approximately equal to a weight of a user, a lift force is applied to the seat body 5 and a body of the user is lifted up by the saddle type seat portion 10 like a gravity-free state, so that the seat body 5 ascends and descends lightly and the user can flex and extend his/her legs with a small load. At that time, since the degree of a load imparted to muscles of his/her both legs can be adjusted arbitrarily by setting of the balancing weights 48*a* to 48*i*, he/she increases a load gradually in conformity with his/her aspect so that he/she can work out in conformity with a personnel reasonably and securely. Accordingly, inferior limb muscles required when a person stands up, sits down, and walks is trained securely, so that a walking ability can be recovered early. The saddle type seat portion 10 is desirable, because a user can change his/her attitude from his/her seating state to his/her standing state smoothly without blocking his/her both legs from flexing and extending.

When the seat body 5 is set to be heavier than a balancing weight load by reducing the number of balancing weights placed on the weight placing stand 45 or adding the weight 34, the load of the seat body 5 is applied to both shoulders of a user in a standing position via the shoulder pads 11*a* and 11*b*. Therefore, a load applied to the user's inferior limb muscles increases so that effective training is made possible not only for the purpose of rehabilitation of a person having difficulty walking but also for the purpose of increasing inferior limb muscle forces of an able-bodied person.

In the weight balancing mechanism 40 described in the embodiment, since the plurality of rod-shaped balancing weights 48*a* to 48*i* are provided in the weight holding frame 46 provided above the weight placing stand 45 so as to penetrate the weight holding frame vertically and the respective balancing weights can be set to enable or disable ascending and descending movement by locking or unlocking the respective balancing weights with the weight locking means 50, weight adjustment applied to the weight placing stand 45 can be conducted by only operation of the weight engaging means, and a setting operation can be conducted very easily without requiring such a troublesome task as moving or loading and unloading heavy weights.

Incidentally, the weight balancing mechanism 40 shown in the embodiment is constituted such that a load applied to the weight placing stand can be adjusted properly by a proper combination of the balancing weights 48*a* to 48*i*, but, for example, such a constitution may be adopted that a hydraulic cylinder is provided instead of the balancing weights and a lift force applied to the seat body is properly adjusted by adjusting the fluid pressure in the hydraulic cylinder. For example, such a constitution may be employed that an electric motor is provided instead of the weight balancing mechanism and the lift force applied to the seat body 5 is adjusted by adjusting the rotational torque of the electric motor.

What is claimed is:

1. An inferior limb muscle force training apparatus comprising:

a supporting strut standing vertically;

a seat body provided so as to be capable of ascending/descending along the supporting strut;

a weight balancing mechanism for applying a lift force to the seat body, the seat body being provided with a saddle type seat portion, the weight balancing mechanism including a rope wound on a pulley provided on an upper portion of the supporting strut, the rope having a first end linked to the seat body and a second end linked to a weight placing stand vertically movable alone a back side of the supporting strut, whereby the weight balancing mechanism is capable of properly adjusting the lift force applied to the seat body; and a weight detachably fixed on the seat body, whereby a total weight of the seat body is adjustable.

2. The inferior limb muscle force training apparatus according to claim 1, wherein the seat body is provided with a pair of shoulder pads.

3. The inferior limb muscle force training apparatus according to claim 1, wherein the weight comprises a plurality of weights detachably fixed on the seat body.

4. An inferior limb muscle force training apparatus comprising:

a supporting strut standing vertically;

a seat body provided so as to be capable of ascending/descending along the supporting strut; and a weight balancing mechanism for applying a lift force to the seat body, the seat body being provided with a saddle type seat portion, and the weight balancing mechanism is capable of properly adjusting the lift force applied to the seat body, wherein the weight balancing mechanism is constructed such that a rope is wound on a pulley provided on an upper portion of the supporting strut, one end of the rope is linked to the seat body, and the other end of the rope is linked to a weight placing stand provided on a back side of the supporting strut to be capable of ascending/descending, and wherein the weight balancing mechanism is constructed such that a weight holding frame is fixed to a rear side of the supporting strut, a plurality of rod-shaped balancing weights are inserted into the weight holding frame vertically and a weight locking means which can be set so as to enable or disable ascending/descending movement of each balancing weight is provided on the weight holding frame, and only a load of the balancing weight set to enable ascending/descending movement by the weight locking means is applied to the weight placing stand.

5. The inferior limb muscle force training apparatus according to claim 4, wherein the seat body is provided with a pair of shoulder pads.

* * * * *